US007664415B2

(12) United States Patent
Mikutsu

(10) Patent No.: US 7,664,415 B2
(45) Date of Patent: Feb. 16, 2010

(54) FIXER, IMAGE FORMING APPARATUS, AND IMAGE FORMING METHOD

(75) Inventor: Yasunari Mikutsu, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 260 days.

(21) Appl. No.: 11/937,101

(22) Filed: Nov. 8, 2007

(65) Prior Publication Data

US 2008/0107436 A1 May 8, 2008

(30) Foreign Application Priority Data

Nov. 8, 2006 (JP) ..... 2006-302311
May 7, 2007 (JP) ..... 2007-122011

(51) Int. Cl.
*G03G 15/20* (2006.01)

(52) U.S. Cl. ..... 399/67; 399/328

(58) Field of Classification Search ..... 399/67, 399/320, 328, 329, 331
See application file for complete search history.

(56) References Cited

U.S. PATENT DOCUMENTS 5,138,379 A * 8/1992 Kanazashi ..... 399/67 X
6,526,239 B2 * 2/2003 Shiiya ..... 399/67
6,687,468 B2 * 2/2004 Holubek et al. ..... 399/67 X

FOREIGN PATENT DOCUMENTS

| | | |
|---|---|---|
| JP | 58-195255 | 12/1983 |
| JP | 8-69202 | 3/1996 |
| JP | 9-160425 | 6/1997 |
| JP | 2005-114959 | 4/2005 |
| JP | 2005-201918 | 7/2005 |

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A fixer for an image forming apparatus includes a fixing member configured to fuse a toner image with heat, a pressure member configured to press against the fixing member to form a nip therebetween, and a control unit configured to control a relative pressure of the pressure member against the fixing member. The control unit includes a cam configured to change a rotation position thereof to change the relative pressure of the pressure member against the fixing member, a driving source configured to drive the cam to rotate, and a controller configured to detect a rotation position of the cam by detecting changes in an electrical current that flows in the driving source when the cam is rotated, and control the rotation position of the cam.

9 Claims, 4 Drawing Sheets

FIXER, IMAGE FORMING APPARATUS, AND IMAGE FORMING METHOD

CROSS-REFERENCE TO RELATED APPLICATIONS

This patent specification claims priority from Japanese Patent Application Nos. JP2006-302311, filed on Nov. 8, 2006 and JP2007-122011, filed on May 7, 2007 in the Japan Patent Office, the entire contents of each of which are hereby incorporated by reference herein.

BACKGROUND OF THE INVENTION

1. Field of the Invention

The present invention generally relates to an image forming apparatus such as a copier, a printer, a facsimile machine, and a multi-function machine including functions of the above, and a fixer included in the image forming apparatus.

2. Discussion of the Background Art

In general, electrophotographic image forming apparatuses include an image forming unit for forming a toner image and a fixer for fixing the toner image on a recording medium.

A fixer includes a fixing member such as a fixing roller, a fixing belt, and a fixing sleeve, and a pressure member such as a pressure roller and a pressing belt. The fixing member and the pressure member are configured to contact each other to form a fixing nip therebetween. A recording medium is transported to the fixing nip, where a toner image on the recording medium is fixed thereon.

In fixers, it is preferable to adjust pressure of the fixing nip according to sheet thickness. Further, a fixing member and/or a pressure member typically include an elastic layer of a foamed rubber to secure a sufficient fixing nip when the diameter thereof is relatively small. When such an elastic layer is used, it is necessary to adjust the pressure frequently to prevent a decrease in hardness, foam breaking, and permanent compression strain of the elastic layer, which may occur when constant pressure is applied to such an elastic layer.

To solve the problems described above, changing the pressure of the pressure member against the fixing member has been proposed.

In one related-art example of a fixer, a pressure roller as a pressure member is pressed against a fixing roller as a fixing member by a pressure lever provided at an axis of the pressure roller. The pressure lever engages a cam and the pressure roller is pressed against or disengaged from the fixing roller when the cam is rotated by a motor.

In another related-art example of a fixer, the pressure of a pressure member on a fixing belt as a fixing member is adjusted to prevent deformation of an elastic layer of the fixing belt.

Yet in another related-art example of a fixer, a pressure member is pressed against a fixing member by rotating a cam. The rotation of the cam is detected with a micro switch that is in contact with the cam.

SUMMARY OF THE INVENTION

In view of the foregoing, various embodiments of the present invention disclosed herein describe a fixer for an image forming apparatus that can enhance fixing properties and reliability in fixing.

In one illustrative embodiment of the present invention, a fixer for an image forming apparatus includes a fixing member configured to fuse a toner image with heat, a pressure member configured to press against the fixing member to form a nip therebetween, and a control unit configured to control a relative pressure of the pressure member against the fixing member. The control unit includes a cam configured to change a rotation position thereof to change the relative pressure of the pressure member against the fixing member, a driving source configured to drive the cam to rotate, and a controller configured to detect a rotation position of the cam by detecting changes in an electrical current that flows in the driving source when the cam is rotated, and control the rotation position of the cam.

In another illustrative example embodiment of the present invention, an image forming apparatus includes an image carrier configured to carry a toner image thereon, a transferer configured to transfer the toner image from the image carrier onto a recording medium, and the fixer described above.

In another illustrative example embodiment of the present invention, a method of fixing the toner image on the recording medium in the fixer described above includes transporting the recording medium through the nip, controlling the relative pressure of the pressure member against the fixing member by changing the rotation position of the cam, detecting changes in an electrical current that flows in the driving source when the cam is rotated, and detecting a rotation position of the cam based on a detection result of the changes in the electrical current.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
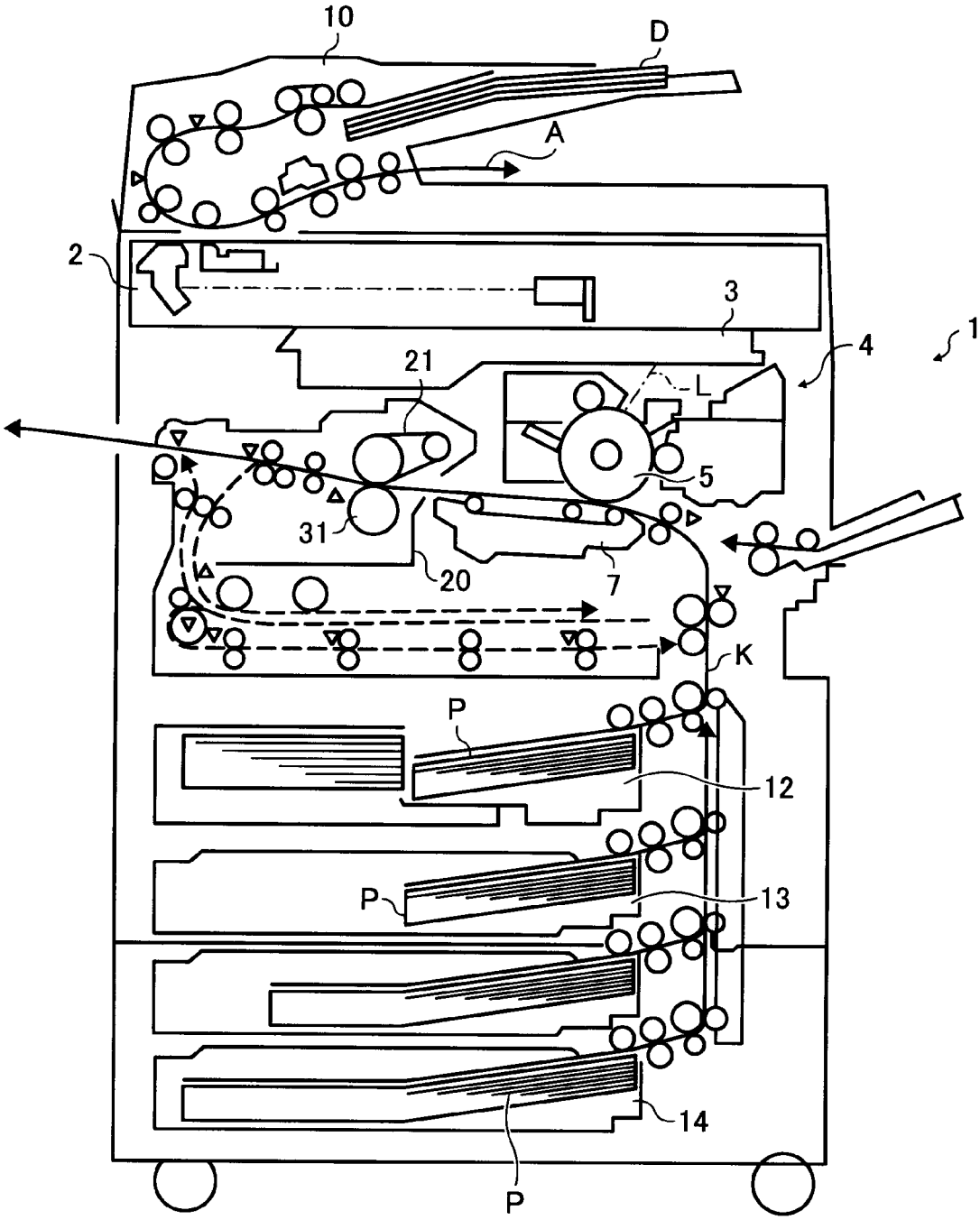
FIG. 1 is an illustration of an image forming apparatus according to an example embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views thereof, and particularly to FIG. 1, an image forming apparatus 1 that is a copier according to an example embodiment of the present invention is described.

Referring to FIG. 1, the image forming apparatus 1 is a copier and includes a reading part 2, an exposure part 3, an image forming part 4, a photoreceptor drum 5, a transferer 7, a document feeder 10 including rollers, and sheet feeders 12 through 14 storing recording media. The reading part 2 scans image information on an original document D. The exposure part 3 directs a laser light L onto a surface of the photoreceptor drum 5 based on the image information read by the reading part 2. The image forming part 4 forms a toner image on the photoreceptor drum 5. The transferee 7 includes a pair of registration rollers and transfers the toner image from the photoreceptor drum 5 onto a sheet P of recording media, for example, transfer paper. The document feeder 10 transports the original document D set therein to the reading part 2.

The image forming apparatus 1 further includes a power source, not shown, and a fixer 20 configured to fix an unfixed toner image on the sheet P. The fixer 20 includes a fixing belt 21 as a fixing member and a pressure roller 31 as a pressure member.

Referring to FIG. 1, operations of the image forming apparatus 1 for forming images are described below.

The rollers in the document feeder 10 transport the original document D in a direction shown by arrow A. While the original document D passes over the reading part 2, the reading part 2 scans the image information on the original document D.

The image information scanned by the reading part 2 is converted into electrical signals and transmitted to the exposure part 3 (writing part). The exposure part 3 directs a laser light L according to the electrical signals to the photoreceptor drum 5 in the image forming part 4.

In the image forming part 4, while the photoreceptor drum 5 rotates clockwise in FIG. 1, a toner image corresponding to the image information is formed on the photoreceptor drum 5 through image forming processes including a charging process, an exposure process, and a developing process.

The transferer 7 transfers the toner image formed on the photoreceptor drum 5 onto the sheet P with the registration rollers.

The sheet P is transported through the image forming apparatus 1 as described below.

One of the sheet feeders 12 through 14 is selected automatically or manually. In an example, the sheet feeder 12, which is the uppermost sheet feeder of the three, is selected. The sheets P in the sheet feeder 12 are sent from the top one by one to a transport path K. In an example embodiment, the image forming apparatus includes a function to detect the thickness of the sheet P.

The sheet P passes through the transport path K and reaches the registration rollers. The registration rollers forward the sheet P in a timely manner to the transferee 7 so that the sheet P overlaps the toner image on the photoreceptor drum 5.

After transferer 7 transfers the toner image onto the sheet P in a transfer process, the sheet P reaches the fixer 20 where the fixing belt 21 and the pressure roller 31 sandwich the sheet P therebetween. After the toner image is fixed on the sheet P with heat from the fixing belt 21 and pressure from both the fixing belt 21 and the pressure roller 31, the sheet P is released from a contact area between the fixing belt 21 and the pressure roller 31 via the sheet P, which is a fixing nip, and discharged as an output image from the image forming apparatus 1, thus completing one sequence of the image forming processes to produce an output image.

Figure 2:
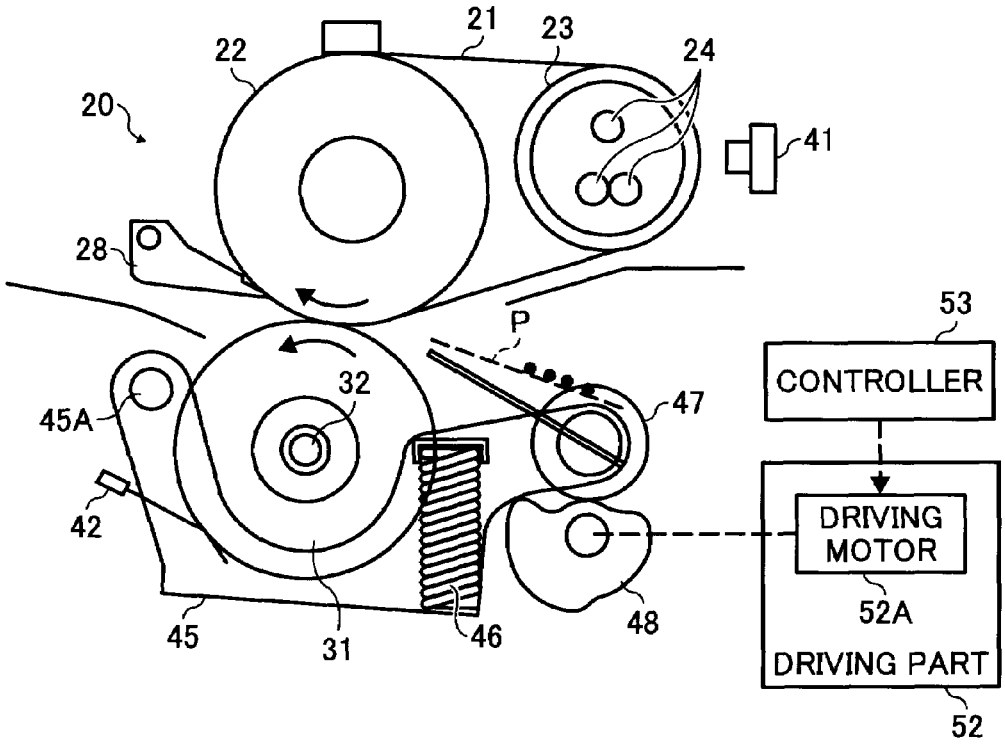
FIG. 2 is an illustration of a fixer according to an example embodiment.
Figure 3:
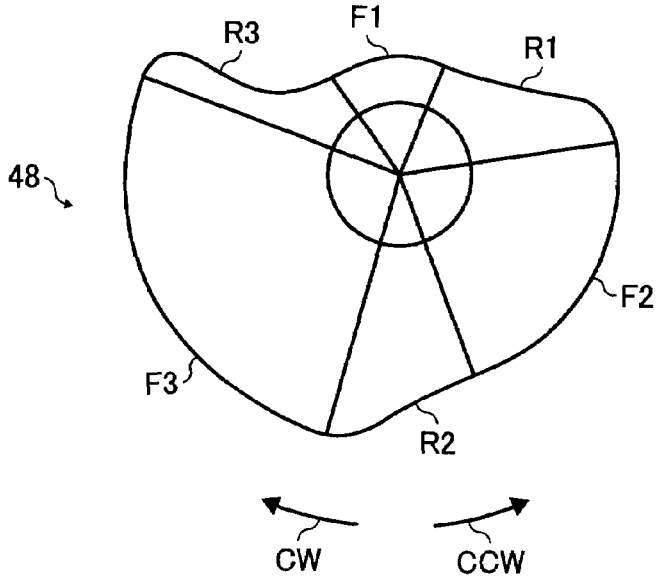
FIG. 3 is an enlarged illustration of a cam provided in the fixer shown in FIG. 2.
Figure 4:
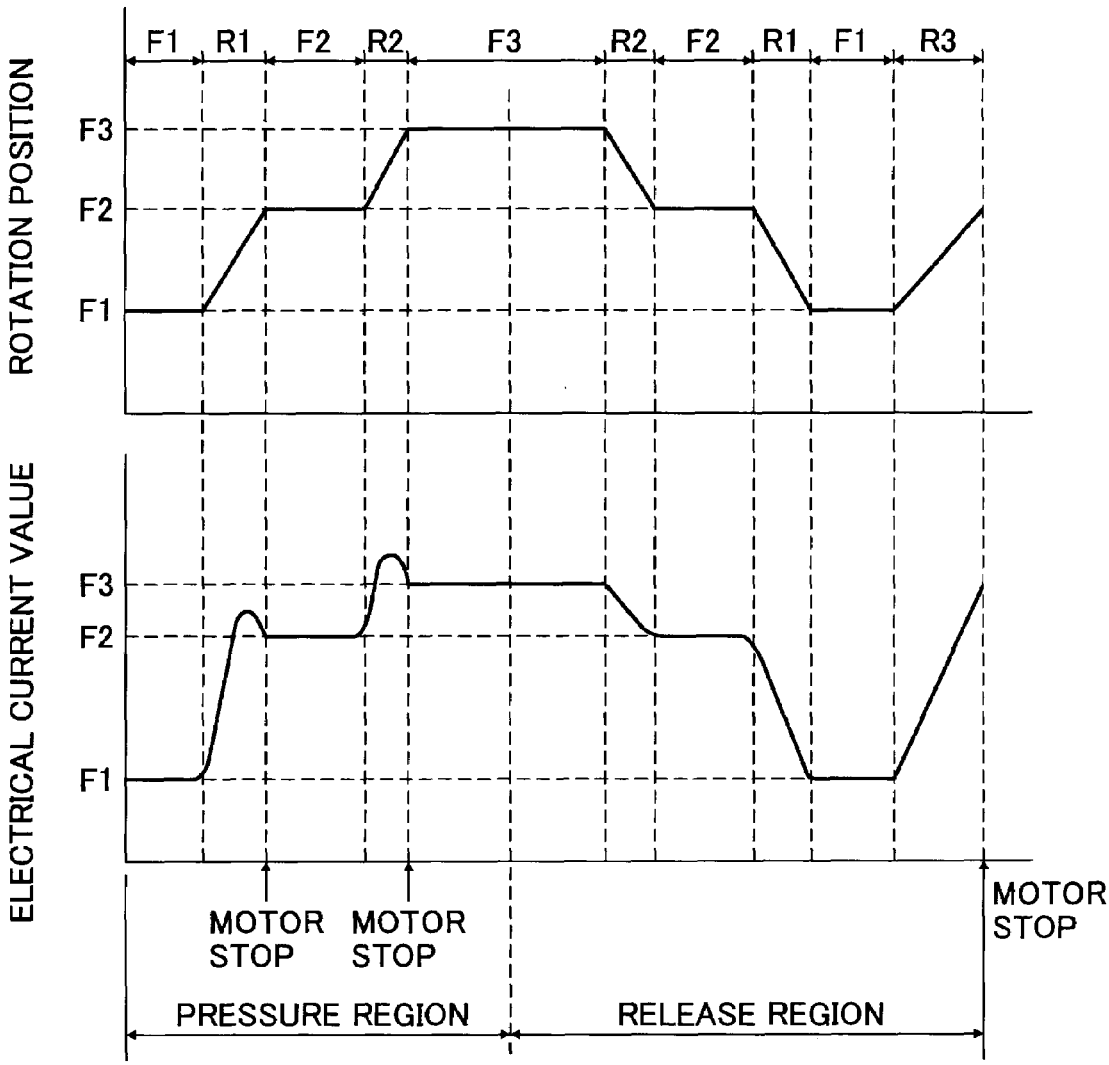
FIG. 4 illustrates a relation between a rotation position of the cam and an electrical current flowing in a driving motor.

Referring to FIGS. 2 through 4, an example configuration and movements of the fixer 20 are described below.

As illustrated in FIG. 2, the fixer 20 includes the fixing belt 21, rollers 22 and 23, the pressure roller 31, a pressure mechanism including a lever 45, a spring 46, and a roller 47, a cam 48, a driving part 52, and a controller 53. The pressure mechanism, the roller 47, the cam 48, the driving part 52, and the controller 53 serve as a control unit. The fixer 20 further includes a separation claw 28 provided near an exit portion of the fixing nip, a thermopile sensor 41 facing a surface of the fixing belt 21, and a thermistor 42 provided to contact a surface of the pressure roller 31. Inside the pressure roller 31, a heater 32 is provided.

The fixing belt 21 (fixing member) is an endless belt that is stretched around the rollers 22 and 23 and runs clockwise in FIG. 2. The roller 22 presses against the pressure roller 31 via the fixing belt 21. The roller 23 includes heaters 24 as heat sources fixed therein. The fixing belt 21 has a multilayer structure including an elastic layer and a release layer, both formed on a base layer, and presses against the pressure roller 31 to form the fixing nip.

Examples of an elastic material for the elastic layer of the fixing belt 21 include fluorine-containing rubber, silicone rubber, and silicone foamed rubber. In particular, using a foamed rubber in the elastic layer provide a sufficient nip.

Examples of a material for the release layer include tetrafluoroethylene-perfluoro(alkyl vinyl ether) copolymer resin (PFA), polyimide, polyether imide, and polyether sulfide (PES). The release layer formed on the surface of the fixing belt 21 provides the fixing belt 21 with a release property to toner (toner images).

The roller 22 includes a metal core and a heat-insulating elastic layer including foamed rubber formed around the metal core. With the insulating elastic layer, a decrease in temperature of the fixing belt 21 can be reduced and a sufficient nip can be formed even if the roller 22 has a smaller diameter.

In an example, the roller 23 is a cylinder including a metal with high thermal conductivity. Each of the heaters 24 located inside the roller 23 may be a halogen heater in the shape of a rod with both ends thereof fixed on side plates of the fixer 20. The heaters 24 heat the fixing belt 21 via the roller 23, and the heat is applied to the toner image on the sheet P from the surface of the fixing belt 21. The power source of the image forming apparatus 1 controls output of each heater 24 based on a surface temperature of the fixing belt 21 detected by the thermopile sensor 41. By controlling output of the heaters 24 as described above, temperature of the fixing belt 21 (fixing temperature) can be set to a preferable temperature.

The pressure roller 31 includes a metal core and an elastic layer formed around an outer surface of the metal core via a bonding layer. Examples of a material for the elastic layer include fluorine-containing rubber, silicone rubber, and silicone foamed rubber. In particular, using a foamed rubber in the elastic layer provides a sufficient nip even if the pressure roller 31 has a smaller diameter. A thin release layer including PFA, etc., may be formed on an outer surface of the elastic layer.

The pressure roller 31 is pressed against the fixing belt 21 by the pressure mechanism including the lever 45, the spring 46 and the roller 47, and thus the fixing nip is formed between the pressure roller 31 and the fixing belt 21.

In the fixer 20 according to an example embodiment, a relative pressure of the pressure roller 31 against the fixing belt 21 can be controlled by changing a position of the cam 48 in a rotation direction thereof (rotation position), thus enabling the size of the fixing nip to be adjusted.

The heater 32 inside the pressure roller 31 may be a halogen heater in the shape of a rod with both ends thereof fixed on the side plates of the fixer 20. The heater 31 heats the fixing belt 21 via the pressure roller 31, and the heat is applied to the toner image on the sheet P from the surface of the fixing belt 21. Output of the heater 32 is controlled based on a surface temperature of the pressure roller 31 detected by the thermistor 42. With the heater 32 provided inside the pressure roller 31, the temperature of the fixing belt 21 can be raised more quickly.

An entry guide plate is provided near an entry portion of the fixing nip to guide the sheet P being sent to the fixing nip. An exit guide plate is provided near the exit portion of the fixing nip to guide the sheet P being released from the fixing nip.

The separation claw 28, which is provided near the exit portion of the fixing nip and faces the outer surface of the fixing belt 22, prevents the sheet P from winding around the fixing belt 21 after the fixing process.

Referring to FIG. 2, features and functions of the fixer 20 are described below.

The lever 45 engages an axis portion of the pressure roller 31 and can rotate about an axis 45A located at an end portion thereof. The spring 46 is provided at a part of the lever 45 and biases the lever 45 downward in FIG. 2, that is, away from the fixing belt 21. The roller 47 is provided at the other end portion of the lever 45 and engages the cam 48.

With the configuration described above, the lever 45 moves up and down when the driving part 52 rotates the cam 48, which makes the pressure roller 31 move up and down. Therefore, the pressure of the pressure roller 31 on the fixing belt, in other words, the size of the fixing nip, can be changed.

The driving part 52 includes a driving motor 52A as a driving source controlled by the controller 53, and a reduction gear line. The cam 48, the pressure mechanism including the lever 45, the spring 46, and the roller 47, the driving part 52, and the controller 53 serve as the control unit to control a relative pressure of the pressure roller 31 against the fixing belt 21 (pressure of the fixing nip). In an example embodiment, the driving motor is a DC motor. The driving part 52 rotates the cam 48 in both forward and reverse directions and the controller 53 increases or decreases the pressure of the fixing nip by controlling a rotation position of the cam 48.

The controller 53 detects the rotation position of the cam 48 by detecting changes in an electrical current that flows in the driving motor 52A when the cam 48 is rotated.

FIG. 3 is an enlarged illustration of the cam 48. As illustrated in FIG. 3, the cam 48 includes engagement areas F1, F2, and F3 and transition areas R1, R2, and R3, along a circumferential surface thereof. The three engagement areas F1, F2, and F3 correspond to different pressures to the fixing nip. Each of the transition area R1, R2, and R3 is for moving to one of the engagement areas F1, F2, and F3 that is adjacent thereto in a rotation direction thereof. In FIG. 3, arrow CCW shows the forward direction and arrow CW shows the reverse direction.

The cam 48 is further described below.

The engagement area F1 is for setting the pressure of the fixing nip to a lower pressure. While the fixing process is not being performed, the controller 53 controls the driving part 52 to set the rotation position of cam 48 to a position 1 at which the engagement area F1 is at a pressure set position, which is a contact position with the roller 47 (lever 45). The driving motor 52A stops rotating in this state. With this configuration, when the elastic layer in the fixing belt 21 and/or the pressure roller 31 includes foamed rubber, the elastic layer is not subject to constant heavy pressure, and thus foam breaking, a decrease in hardness, permanent compression strain of the elastic layer and so forth can be prevented or reduced.

The engagement area F2 is for setting the pressure of the fixing nip to a standard pressure. While fixing is performed on sheets having a standard thickness, the controller 53 controls the driving part 52 to set the rotation position of the cam 48 to a position 2 at which the engagement area F2 is at the pressure set position.

The engagement area F3 is for setting the pressure of the fixing nip to a higher pressure. While fixing is performed on thicker sheets than the standard thickness, the controller 53 controls the driving part 52 to set the a rotation position of the cam 48 to a position 3 at which the engagement area F3 is at the pressure set position. Because size of the fixing nip is adjusted to an optimum value by changing the pressure of the fixing nip according to sheet thickness as described above, a good fixing property can be obtained constantly.

In each of the transition area R1 between the engagement areas F1 and F2, the transition area R2 between the engagement areas F2 and F3, and the transition area R3 between the engagement areas F3 and F1, a distance from a rotation axis of the cam 48 to the circumferential surface thereof greatly changes with the rotation thereof.

The circumferential surface of the cam 48 is configured as shown in an upper graph shown in FIG. 4. In the upper graph, a horizontal axis represents the circumferential area of the cam 48 that is at the pressure set position (contact position with the roller 47). A vertical axis represents a distance from the rotation axis of the cam 48 to the circumferential surface thereof. A lower graph shown in FIG. 4 shows a relation between the rotation position of the cam 48 and changes in the electrical current flowing in the driving motor 52A. In the lower graph, a vertical axis shows the value of the electrical current flowing in the driving motor 52A.

When the cam 48 is rotated in both the forward and the reverse directions, the electrical current flowing in the driving motor 52A (DC motor) changes as illustrated in the lower graph shown in FIG. 4.

In a case that the cam 48 is rotated in the forward direction shown by arrow CCW in FIG. 3 in a pressure region shown in the lower graph shown in FIG. 4 from the position 1, the transition area R1 passes the pressure set position before the engagement area F2 reaches the pressure set position (position 2). While the transition area R1 passes the pressure set position, the distance from the rotation axis of the cam 48 to the circumferential surface thereof increase greatly, and a load to the driving motor 52A increases greatly. As a result, the electrical current flowing in the driving motor 52A increases greatly.

When the cam 48 is further rotated in the forward direction, the transition area R2 passes the pressure set position and the engagement area F3 reaches the pressure set position (position 3). While the transition area R2 passes the pressure set position, the distance from the rotation axis of the cam 48 to the circumferential surface thereof further increases greatly, and thus the electrical current flowing in the driving motor 52A further increases greatly.

By contrast, in a case in which the cam 48 is rotated in the reverse direction shown by arrow CW in FIG. 3 in a release region shown in the lower graph shown in FIG. 4, the rotation position thereof changes from the position 3 to the position 2 at which the engagement area F2 is at the pressure set position. In this reverse rotation, while the transition area R2 passes the pressure set position, the distance from the rotation axis of the cam 48 to the circumferential surface thereof decreases greatly, and the load to the driving motor 52A decreases greatly. As a result, the electrical current flowing in the driving motor 52A decreases greatly.

When the cam 48 is further rotated in the reverse direction, the rotation position thereof changes to the position 1 at which the engagement area F1 is at the pressure set position. The distance from the rotation axis of the cam 48 to the circumferential surface thereof further decreases greatly while the transition area R1 passes the pressure set position. As a result, the electrical current flowing in the driving motor 52A further decreases greatly.

When the cam 48 is further rotated in the reverse direction, the distance from the rotation axis of the cam 48 to the circumferential surface thereof increase greatly while the transition area R3 passes the pressure set position before the engagement area F3 reaches the pressure set position (position 3). As a result, the electrical current flowing in the driving motor 52A increases greatly.

As described above, in an example embodiment, when the pressure of the fixing nip is changed by rotating the cam 48, the electrical current flowing in the driving motor 52A changes greatly, and thus the rotation position of the cam 48 can be detected based on a detection result of the electric current. Although the rotation position of the cam may be detected with an optical sensor, a micro switch, etc., a space for the optical sensor or the micro switch and related component thereto is necessary and the shape of the cam may be limited in such cases. Therefore, the rotation position of the cam 48 can be detected accurately and simply, without an optical sensor, a micro switch, etc., and used optimize the pressure of the fixing nip, by detecting the electrical current flowing in the driving source 52A that rotatably drives the cam 48.

It is to be noted that, although the engagement area F1 of the cam 48 is configured to reduce the pressure of the fixing nip to a given lower pressure in the present embodiment, the engagement area F1 may be configured to reduce the pressure to zero.

In an example embodiment, the control unit is configured so that a rotation time T, which is a time period required to set one of the engagement areas F1 through F3 of the cam 48 to the pressure set position, satisfies the following relationship:

$$T \leqq T1 - T2$$

wherein T1 is a first print time that is a time period required to produce an output image and T2 is a time period from when a transport of a sheet P is started until when the sheet P reaches the fixing nip.

With the configuration described above, the effect of changing the pressure of the fixing nip can be attained because the control unit sets the pressure of the fixing nip to a preferred pressure before a sheet P reaches the fixing nip after image forming starts.

Operations of the fixer 20 configured as described above are described below, referring to FIGS. 1 and 2.

When the image forming apparatus 1 is powered on, the heaters 24 and 32 are activated, and the fixing belt 21 and the pressure roller 31 start to rotate in directions shown by arrows as illustrated in FIG. 2.

A sheet P is transported from one of the sheet feeders 12 through 14 to the image forming part 4, where a toner image is formed on the sheet P. The sheet P carrying the toner image thereon is transported, guided by the entry guide plate, into the fixing nip formed by the fixing belt 21 and the pressure roller 31 that are pressed against each other. The pressure of the fixing nip (size of fixing nip) is adjusted to an optimum value by a cam 48, a driving part 52, a controller 53, and the pressure mechanism including a lever 45, a spring 46, and a roller 47.

After the toner image is fixed on the sheet P with heat and pressure from the fixing belt 21 and the pressure roller 31, the sheet P is released from the fixing nip and discharged from the image forming apparatus 1.

As described above, when a relative pressure of the pressure roller 31 to the fixing belt 21 is changed by rotating the cam 48, the electrical current value flowing in the driving motor 52A is detected. Therefore, the pressure is easily ascertained with a higher degree of accuracy, and thus the pressure of the fixing nip can be adjusted to an optimum value and reliable fixing achieved.

It should be noted that although the image forming apparatus 1 is described as a copier in the foregoing embodiment, the image forming apparatus of the present invention is not limited thereto.

Figure 5:
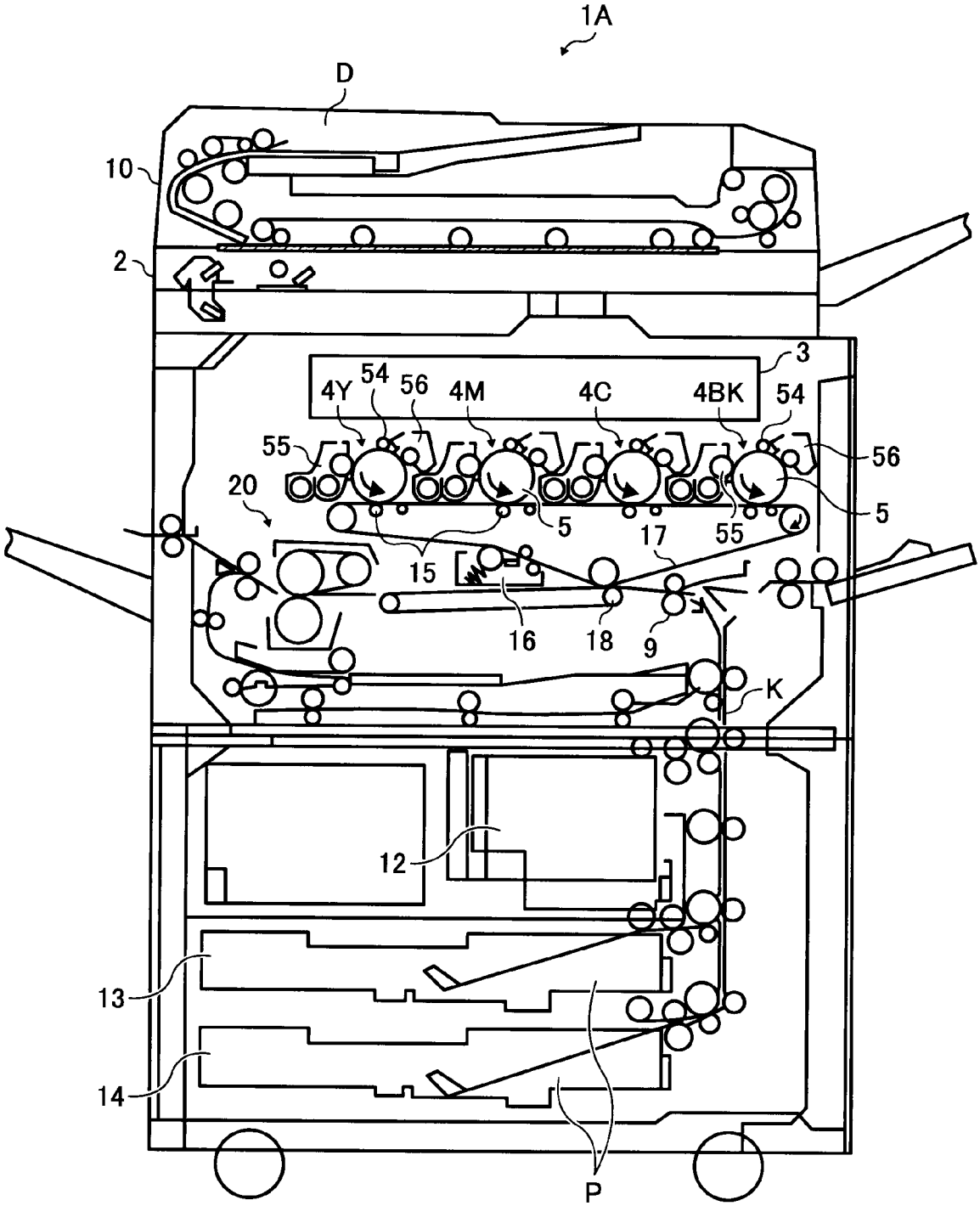
FIG. 5 is an illustration of an image forming apparatus according to an example embodiment.

Referring to FIG. 5, a tandem image forming apparatus 1A according to an example embodiment is described below.

In FIG. 5, the image forming apparatus 1A includes a reading part 2, an exposure part 3, image forming parts 4Y, 4*m*, 4C, and 4BK for forming toner images of yellow, magenta, cyan, and black, photoreceptor drums 5, a document feeder 10 including a document table and rollers, and sheet feeders 12 through 14 storing recording media. The image forming apparatus 1A further includes a pair of registration rollers 9 to adjust a timing to forward a sheet P, primary transfer rollers 15, a belt cleaner 16 to clean an intermediate transfer belt 17, a secondary transfer roller 18, a fixer 20, and an image processor, not shown.

The primary transfer roller 15 transfers toner images on the photoreceptor drums 5 and superimposes the toner images one on another on the intermediate transfer belt 17. The secondary transfer roller 18 transfers the superimposed toner image, which is a color image, from the intermediate transfer belt 17 onto the sheet P.

Each part of the image forming apparatus 1A that is similar to a corresponding part of the image forming apparatus 1 shown in FIG. 1 is given the same reference numeral, and a description thereof thus omitted.

Each of the image forming parts 4Y, 4M, 4C, and 4BK includes a charger 54 to charge the photoreceptor drum 5, a developing unit 55 to develop an electrostatic latent image formed on the photoreceptor drum 5, and a cleaner 56 to remove toner that is not transferred to the intermediate transfer belt 17 from the photoreceptor drums 5.

The fixer 20 in the image forming apparatus 1A functions similarly to the fixer 20 in the image forming apparatus 1 shown in FIG. 1. That is, an electrical current flowing in the driving motor 52A is detected while the cam 48 is rotated to change the relative pressure of the pressure roller 31 against the fixing belt 21.

Forming a color image with the image forming apparatus 1A is described below.

The rollers in the document feeder 10 transport an original document D from the document table to a contact glass of the reading part 2, where image information on the original document D is scanned.

The reading part 2 scans the original document D while applying light thereto from an illumination lamp. The light is reflected by the surface of the original document D and imaged on a color sensor through mirrors and a lens. The color image information of the original document D is read for each color separation light of RGB (red, green, and blue) and converted into electrical image signals. Further, the image processor performs color conversion, color correction, space frequency correction, etc., according to the electrical image signals and generates yellow, magenta, cyan, and black color image information.

The color image information of yellow, magenta, cyan, and black is transmitted to the exposure part 3. The exposure part 3 directs laser lights onto the photoreceptors 5 in the image forming part 4Y, 4M, 4C, and 4BK, based on respective color image information.

While the above processes are performed, each of the photoreceptor drums 5 is rotated clockwise in FIG. 5, which is hereinafter referred to as the drum rotation direction. The surface of each photoreceptor drum 5 is charged uniformly at a position facing the charger 54 in a charging process, and thus a charge potential is formed on each photoreceptor drum 5. The charged surface of each photoreceptor drum 5 reaches a position to receive the laser light.

The exposure part 3 emits laser lights from four light sources thereof according to the image signals for respective colors in an exposure process. The laser lights pass through different light paths for yellow, magenta, cyan, and black.

The laser light for a yellow component is applied to the surface of the photoreceptor drum 5 in a first image forming part (4Y) from left in FIG. 5. The exposure part 3 scans the laser light for the yellow component with a polygon mirror rotating at high speed across the photoreceptor drum 5 in the drum rotation direction, which is a main scanning direction. Thus, an electrostatic latent image for the yellow component is formed on the photoreceptor drum 5 after the charger 54 charges the photoreceptor drum 5.

Similarly, the laser light for a magenta component is applied to the surface of the photoreceptor drum 5 in a second image forming part (4M) from left in FIG. 5, and thus an electrostatic latent image for the magenta component is formed thereon. The laser light for a cyan component is applied to the surface of the photoreceptor drum 5 in a third image forming part (4C) from left in FIG. 5, and thus an electrostatic latent image for the cyan component is formed on thereon. The laser light for a black component is applied to the surface of the photoreceptor drum 5 in a fourth image forming part (4BK) from left in FIG. 5, and thus an electrostatic latent image for the black component is formed thereon.

The surface of each photoreceptor drum 5 on which the electrostatic latent image of each color is formed reaches a position facing the developing unit 55, which develops the electrostatic latent image into a toner image with a toner of corresponding color in a developing process.

After the developing process, the surface of each photoreceptor drum 5 reaches a position facing the intermediate transfer belt 17, where the primary transfer roller 15 is provided to contact an inner surface of the intermediate transfer belt 17. At the positions facing the primary transfer rollers 15, the toner images on the respective photoreceptor drums 5 are transferred onto the intermediate transfer belt 17 so as to be superimposed one on another as a color image in a primary transfer process.

After the primary transfer process, the surface of each photoreceptor drum 5 reaches a position facing the cleaner 56. The cleaner 56 removes toner remaining on respective photoreceptor drums 5 in a cleaning process.

The surface of each photoreceptor drum 5 further passes a discharge area, thus completing a series of image forming processes on the photoreceptor drums 5.

The intermediate transfer belt 17 on which the superimposed color image is formed rotates clockwise in FIG. 5 and reaches a position facing the secondary transfer roller 18, where the color image is transferred onto the sheet P in a secondary transfer process.

The surface of the intermediate transfer belt 17 further rotates and reaches a position facing the belt cleaner 16. The belt cleaner 16 collects toner that is not transferred onto the sheet P from the intermediate transfer belt 17, thus completing a series of transfer processes on the intermediate transfer belt.

In the processes described above, the sheet P is fed from one of the sheet feeders 12, 13, and 14 via the registration rollers 9 to a secondary transfer nip, which is formed between the intermediate transfer belt 17 and the secondary transfer roller 18.

More specifically, the sheet P is fed from one of the sheet feeders 12, 13, and 14 to the registration rollers 9, guided by a transport guide. The registration rollers 9 forward the sheet P in a timely manner to the secondary transfer nip.

After the full color image is transferred onto the sheet P, the sheet P is transported to the fixer 20 by a transport belt. In the fixer 20, the color image is fixed on the sheet P in the fixing nip between the fixing belt 21 and the pressure roller 31 in a fixing process.

After the fixing process, the sheet P is discharged by a pair of discharge rollers from the image forming apparatus 1A as an output image, thus completing a sequence of image forming processes.

As described above, when a relative pressure of the pressure roller 31 against the fixing belt 21 is changed by rotating the cam 48, a change in the electrical current value flowing in the driving motor 52A is detected. Therefore, the pressure can be easily ascertained with a higher degree of accuracy, and thus the pressure of the fixing nip can be adjusted to an optimum value and reliable fixing secured.

It is to be noted that the present invention may be applied to an electromagnetic induction heating fixer, even though the description above concerns a heater lamp heating fixer. With an electromagnetic induction heating fixer as well, effects similar to the effects described above can be achieved.

Further, although the fixing member is a fixing belt in the description above, the present invention may be applied to a fixer using a fixing roller as a fixing member. Further, the present invention may be applied to a fixer using a fixing belt as a fixing member and a pressure belt as a pressure member, a fixer including a pad in a fixing member such as a fixing sleeve, etc., and forming a nip at a contact position between the fixing member and a pressure member, and a fixer including a plurality of fixing nips formed between a fixing member and a pressure member.

Although the pressure roller 31 is pressed against the fixing belt 21 to form a fixing nip therebetween in the description above, a fixing member may be pressed against a pressure member to form a fixing nip therebetween. In this case, similar effects can be achieved by changing a relative pressure of the fixing member against the pressure member with a control unit and detecting an electrical current flowing in a driving motor to drive a cam.

As can be appreciated by those skilled in the art, numerous additional modifications and variations are possible in light of the above teachings. It is therefore to be understood that, within the scope of the appended claims, the disclosure of this patent specification may be practiced otherwise than as specifically described herein.

What is claimed is:

1. A fixer for an image forming apparatus, comprising:

a fixing member configured to fuse a toner image on a recording medium with heat;

a pressure member configured to press against the fixing member to form a nip therebetween; and a control unit configured to control a relative pressure of the pressure member against the fixing member, the control unit comprising:

a cam configured to change a rotation position thereof to change the relative pressure of the pressure member against the fixing member;

a driving source configured to rotatably drive the cam; and a controller configured to detect a rotation position of the cam by detecting changes in an electrical current that flows in the driving source when the cam is rotated, and control the rotation position of the cam.

2. The fixer of claim 1, wherein the cam comprises:

a plurality of engagement areas configured to set the relative pressure to different pressures; and a plurality of transition areas each configured to move to one of the engagement areas that is adjacent thereto in a rotation direction thereof, wherein a distance from a rotation axis of the cam to a circumference of the cam changes in the transition areas with rotation of the cam.

3. The fixer of claim 2, wherein at least one of the engagement areas sets the relative pressure to zero.

4. The fixer of claim 3, wherein a rotation time of the cam required to set one of the engagement area of the cam to a pressure set position satisfies a relation $$T \leqq T1 - T2$$

wherein T is the rotation time of the cam, T1 is a first print time, and T2 is a time period from when transport of the recording medium starts until when the recording medium reaches the nip.

5. The fixer of claim 1, wherein the control unit controls the relative pressure by rotating the cam in a forward direction and a reverse direction with the driving source.

6. The fixer of claim 1, wherein the driving source is a DC motor.

7. The fixer of claim 1, wherein at least one of the fixing member and the pressure member comprises an elastic layer including a foamed rubber.

8. An image forming apparatus comprising:

an image carrier configured to carry a toner image thereon;

a transferer configured to transfer the toner image from the image carrier onto a recording medium; and the fixer according to claim 1.

9. A method of fixing a toner image on a recording medium in a fixer having a fixing member configured to fuse the toner image on the recording medium with heat, a pressure member configured to press against the fixing member to form a nip therebetween, a cam configured to change a rotation position thereof to change a relative pressure of the pressure member against the fixing member, and a driving source configured to rotatably drive the cam, the method of fixing the toner image on the recording method comprising:

transporting the recording medium through the nip;

controlling the relative pressure of the pressure member against the fixing member by changing the rotation position of the cam;

detecting changes in an electrical current that flows in the driving source when the cam is rotated; and ascertaining a rotation position of the cam based on a detection result of the changes in the electrical current that flows in the driving source when the cam is rotated.

* * * * *